US010077607B2

(12) United States Patent
Frost et al.

(10) Patent No.: US 10,077,607 B2
(45) Date of Patent: Sep. 18, 2018

(54) DRILL HEAD BORER

(71) Applicant: BELLTEC INDUSTRIES, INC., Belton, TX (US)

(72) Inventors: Robert L. Frost, Sherman, TX (US); Louis S. Miliman, Salado, TX (US); Alan L. Jones, Belton, TX (US)

(73) Assignee: Belltec Industries, Inc., Belton, TX (US)

( * ) Notice: Subject to any disclaimer, the term of this patent is extended or adjusted under 35 U.S.C. 154(b) by 371 days.

(21) Appl. No.: 14/970,815

(22) Filed: Dec. 16, 2015

(65) Prior Publication Data

US 2016/0230469 A1 Aug. 11, 2016

Related U.S. Application Data

(60) Provisional application No. 62/114,151, filed on Feb. 10, 2015.

(51) Int. Cl.
*E21B 10/44* (2006.01)

(52) U.S. Cl.
CPC ..... *E21B 10/44* (2013.01)

(58) Field of Classification Search
CPC ..... E21B 10/44; E21B 7/28
See application file for complete search history.

(56) References Cited

U.S. PATENT DOCUMENTS 5,476,149 A * 12/1995 Rickards ..... E21B 10/44
175/388

* cited by examiner

*Primary Examiner* — Wei Wang
(74) *Attorney, Agent, or Firm* — Sand & Sebolt

(57) ABSTRACT

A drill head borer is configured to be attached to a rotary auger including a helical blade. The borer includes at least one wing extending radially away from a body centered about a longitudinal axis. An aligning ledge is formed in the drill head borer configured to self-align the drill head borer with the helical blade without the need for substantial measurement by a user. The borer further includes a plurality of teeth arranged in a convex configuration, along the wing when viewed from above. When viewed from the side, the teeth are angled at a lifting pitch angle.

17 Claims, 12 Drawing Sheets

DRILL HEAD BORER

CROSS REFERENCE TO RELATED APPLICATION

This application claims the benefit of U.S. Provisional Application Ser. No. 62/114,151, filed on Feb. 10, 2015; the disclosure of which is entirely incorporated herein by reference as if fully rewritten.

BACKGROUND

Technical Field

The present disclosure relates generally to the field of drilling heads. More particularly, the present disclosure relates to a cast drill head. Specifically, the present disclosure relates to a cast drill head including replaceable teeth arranging in a convex pattern and a ledge to self-align the drill head to a helical body/blade on the rotary auger.

Background Information

Rotary augers are tools used in drilling holes, and often powered by a motor. The conventional rotary auger includes at least one helical blade that lifts substrate material such as rock, dirt, and gravel upwardly from downhole as the auger rotates about a longitudinal axis to drill downwardly. Some rotary augers include two helical blades that wind about a drive shaft in a double-helical manner and cooperate to removably lift substrate from the hole during drilling.

Drilling heads are usually attached to the bottom (i.e. the downhole cutting end) of the rotary auger. The drill heads must be aligned to the bottom edge of the helical blade to ensure a smooth lifting of substrate. The drill heads ordinarily require precision alignments to ensure smooth upward flow out of the hole.

The drill heads may include a plurality of teeth attached thereto in order to cut or break the soil/rock substrate. Most of the known drill heads are on a "fixed-flat" cutting surface, which refers to cutter bits bolted onto a flat metal plate. The flat metal plate is substantially horizontal when viewed from the side. The teeth cut through the substrate as the auger rotates and bores downward. Furthermore, the teeth wear down through the continued use and require replacement when showing excess wear.

SUMMARY

Issues continue to exist with drill heads for rotary augers as presently known in the art. Firstly, these known drill heads are difficult to align with the helical blade on the rotary auger body. The difficulty associated with aligning the drill head with the blade of the auger inhibits cut material from flowing smoothly/fluidly and efficiently out of the downhole bore. Furthermore, difficulties continue to exist with wearable components, such as the teeth, on the drill heads. The present disclosure addresses these and other issues.

In one aspect, one embodiment of the present disclosure may provide a drill head borer comprising: a body centered along a longitudinal axis; a first wing extending radially from the body to an end; and a ledge on the first wing for self-aligning the drill head borer to a helical body on a rotary auger. This drill head borer may further comprise a plurality of teeth coupled to the first wing in a convex arrangement between the body and the end of the first wing. Additionally, the drill head borer may further comprise: a lateral axis perpendicularly intersecting the longitudinal axis when viewed from above; a first tooth angularly displaced at a first angle relative to the lateral axis; a second tooth angularly displaced at a second angle relative to the lateral axis; and wherein the second angle is less than the first angle.

In another aspect, an embodiment the present disclosure may provide a drill head borer that is configured to be attached to a rotary auger including a helical blade. The drill head borer includes at least one wing extending radially away from a body centered about a longitudinal axis. An aligning ledge is formed in the drill head borer configured to self-align the drill head borer with the helical blade without the need for substantial measurement by a user. The drill head borer further includes a plurality of teeth arranged in a convex configuration, when viewed from above, along the wing. When viewed from the side, the teeth are angled at a lifting pitch angle.

In one aspect, an embodiment of the present disclosure may provide a boring drill head attachment for an auger comprising: a central body adapted to attach to a downhole end of a substrate lifting helical flight on an auger; a first wing extending transversely outward from a first rigid connection with the body to a wing end; a plurality of plates supporting teeth on the first wing, each plate including a leading edge; each leading edge respectively associated with the plurality of plates offset at angle relative to the body; and a convexly curved arrangement of the leading edges of the plurality of support plates when viewed from above.

In yet another aspect, an embodiment of the present disclosure may provide a method of drilling a hole with an auger, comprising the steps of: providing a body having an upper end opposite a lower end centered about a vertically aligned longitudinal axis, the body attached to a downhole end of a helical flight on the auger, and further having a first wing including a tooth support plate having an angled upwardly facing top surface and a bottom surface, the support plate defining a aperture extending therethrough, and further a tooth defining a slot aligned with the aperture coupled to the support plate via a fastener; rotating the body about the longitudinal axis and moving the tooth in unison therewith; contacting a downhole substrate with the tooth; and lifting substrate upwards. This method may further provide wherein the step of contacting a down hole substrate further comprises the steps of: providing a plurality of teeth defining slots respectively coupled to a plurality of support plates defining through apertures with fasteners having squared necks; and contacting substantially simultaneously a horizontal plane associated with the downhole substrate with the plurality of teeth. Additionally, this method may provide the step of preventing the plurality of teeth from dislodging from the support plate when the auger is reversed. And, wherein the step of preventing the plurality of teeth from dislodging from the support plate when the auger is reversed is accomplished by contacting a squared neck portion on a carriage bolt with a squared wall on a tang of each tooth defining the slot. Additionally, this method may provide the step of reducing radial pull of an outermost tooth by arranging the plurality of teeth in a convex pattern when viewed from above. Further, this method may further comprise the step of reducing radial pull of an outermost tooth simultaneous with the step of lifting substrate upwards, wherein the step of reducing radial pull is accomplished by: providing a plurality of teeth, wherein each tooth from the plurality of teeth is supported by a corresponding tooth support plate; and aligning a leading edge on each tooth from the plurality of teeth at a different displacement angle relative to the body; wherein the aligned leading edges form a convexly curved arrangement when viewed from above.

In yet another aspect, an embodiment of the present disclosure may provide a method of drilling a hole with an auger, comprising the steps of: rotating a drill head about a longitudinal axis, wherein the drill head includes a plurality of teeth extending radially in a convex configuration when viewed from above; and contacting a downhole substrate at a horizontal plane substantially simultaneously with all of the plurality of teeth.

BRIEF DESCRIPTION OF THE SEVERAL VIEWS OF THE DRAWINGS

A sample embodiment of the present disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the present disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
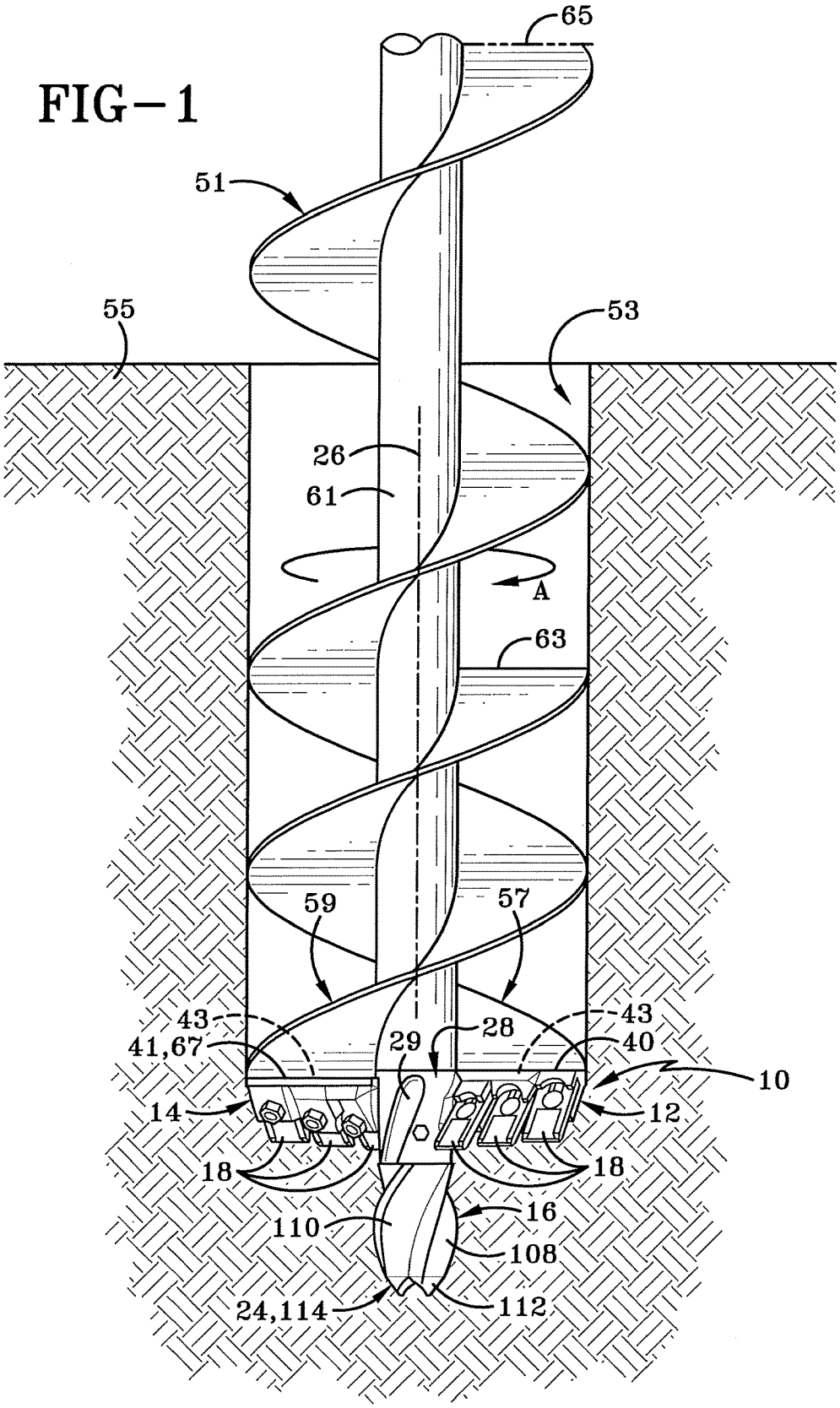
FIG. 1 is an environmental side view of a boring drill head attached to a double cut single flight auger.
Figure 2:
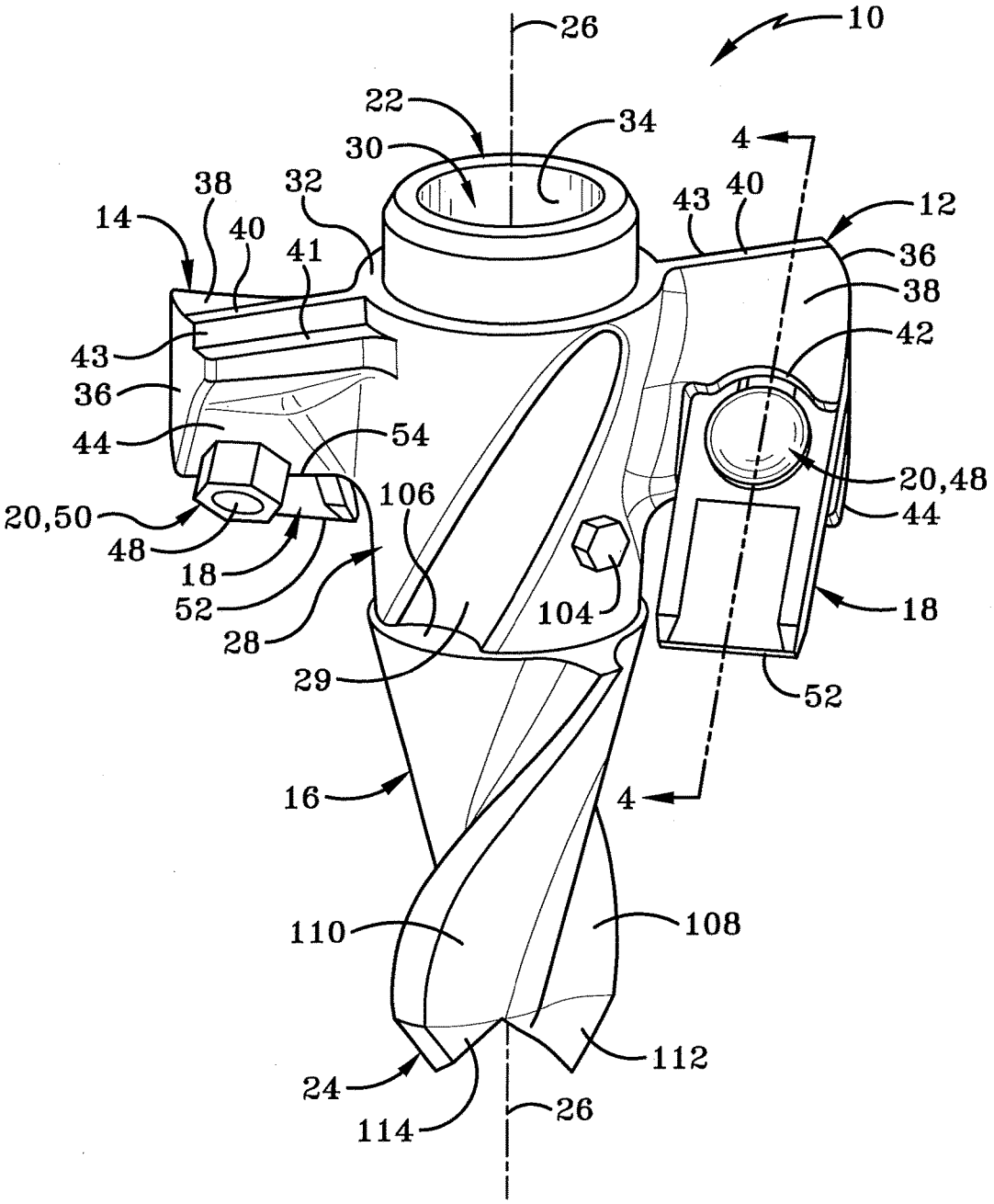
FIG. 2 is a perspective view of a first embodiment drill head borer which is the subject of the present disclosure.

As depicted in FIG. 1, a boring drill head for attaching to an auger, also referred to as a drill head borer, of the present disclosure is generally indicated at 10. Borer 10 includes a first wing 12, a second wing 14, a pilot tip or pilot cutter 16, a tooth or plurality of teeth 18, and a fastener 20 (FIG. 2). Borer 10 includes an upwardly facing top end 22 (FIG. 2) spaced apart from a bottom end defined by downwardly extending fishtail teeth 24 defining a longitudinal direction therebetween. Borer 10 is centered longitudinally about longitudinal axis 26 (FIG. 2) and some components described herein will be made with reference to extending radially outward from longitudinal axis 26.

Borer 10 may also be referred to throughout the present disclosure as boring drill head 10. As depicted in FIG. 1, boring drill head 10 may be attached to a double cut, single flight auger 51 in order to drill a hole 53 into earth 55 as will be described in greater detail below. Clearly other augers are entirely possible as well. Auger 51 has a first cutting flight 57 aligned with first wing 12, and a second cutting flight 59 aligned with second wing 14. First cutting flight 57 extends upwardly from its connection with first wing 12 in a helical manner around shaft 61 one revolution and terminating at an upper end 63. Second cutting flight 59 extends from second wing 14 helically around shaft 61 to an upper end 65 closely adjacent the upper end of shaft 61 that is received by a motor. As will be described in greater detail below, shaft 61 is configured to rotate in the direction of Arrow A (FIG. 1) about vertically extending long axis 26.

Figure 8:
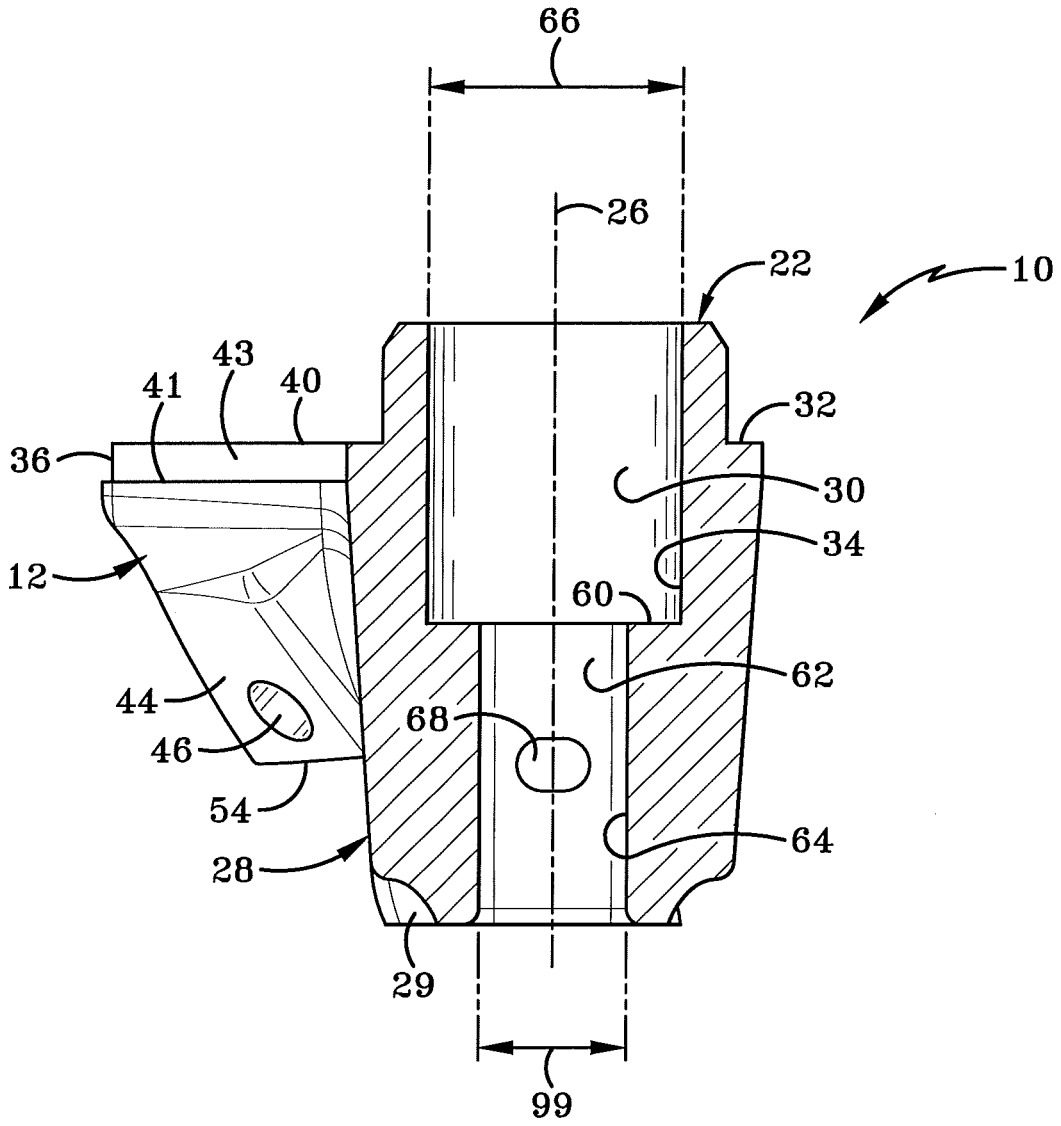
FIG. 8 is a cross section taken along line 8-8 in FIG. 6.

Within continued reference to FIGS. 1-2, borer 10 further includes a generally cylindrical body 28 defining a first cylindrical bore 30 therein centered about longitudinal axis 26. Body 28 further defines an annular ledge 32 extending circumferentially about longitudinal axis 26 in the body sidewall. Ledge 32 is disposed about the outer surface of body 28. In one particular embodiment, cylindrical body 28 tapers inwardly towards longitudinal axis 26 as the outer surface of body 28 extends downwardly from the top end 22. An inner surface 34 (FIG. 2) partially defining bore 30 is generally uniformly offset from longitudinal axis 26 forming a generally flat wall when viewed in cross section (FIG. 8).

A pair of diametrically opposite flutes 29 may be formed in the outer surface of body 28. Flutes 29 extend helically about and radially offset from longitudinal axis 26 in the outer surface of body 28. Flutes 29 assist and facilitate in the lifting of cut materials (e.g., rock and dirt) upwardly and away from borer 10 as device drills downhole.

First wing 12 extends radially away from longitudinal axis 26 from a rigid and fixed connection with cylindrical body 28 terminating at a wing end 36. First wing 12 further includes an angled retention flange 38 sloping downwardly from a top surface 40 terminating at a concave edge 42. A support plate 44 is disposed beneath flange 38 angled in a manner parallel to angled flange 38. A gap 25 is defined between the bottom surface of flange 38 and the upper surface of support plate 44. The gap distance, or gap thickness, is generally equal to the thickness of tooth 18. As will be described in greater detail below, portions of tooth 18 (e.g. a tang 19 portion of tooth 18) fit within the gap between flange 38 and support plate 44. Support plate 44 defines an aperture 46 extending fully through support plate 44 and configured to receive the portion of fastener 20 therethrough. In one particular embodiment, fastener 20 is a carriage bolt 48 and a nut 50.

On each wing 12, 14 there is an aligning ledge 41. Ledge 41 is disposed vertically lower than the top 40 and extends in a horizontal direction (when viewed in a side elevation view) opposite that of support plate 44. Ledge 41 is rigidly fixed to generally cylindrical body 28. In the shown embodiment, aligning ledge 41 has width 91 of about 0.41875 inches, however it is contemplated that ledge 41 may be a variety of widths in a range from about 0.1" to about 2", wherein the width is dependent on a helical flight on a rotary auger. Aligning ledge 41 creates a self-aligning function for borer 10 when needing to be aligned with a bottom edge of the helical flight on a rotary auger. Ledge 41 defines a surface upon which the bottom edge 67 of helical flight on a rotary auger contacts when installing borer 10. Furthermore, a vertical sidewall 43 extending upwardly from ledge 41 to top surface 40 defines a stop structure assisting in aligning borer 10 with helical flight on a rotary auger. An outer diameter 93 is measured from end 36 on first wing 12 to outer end 36 on second wing 14.

Figure 3:
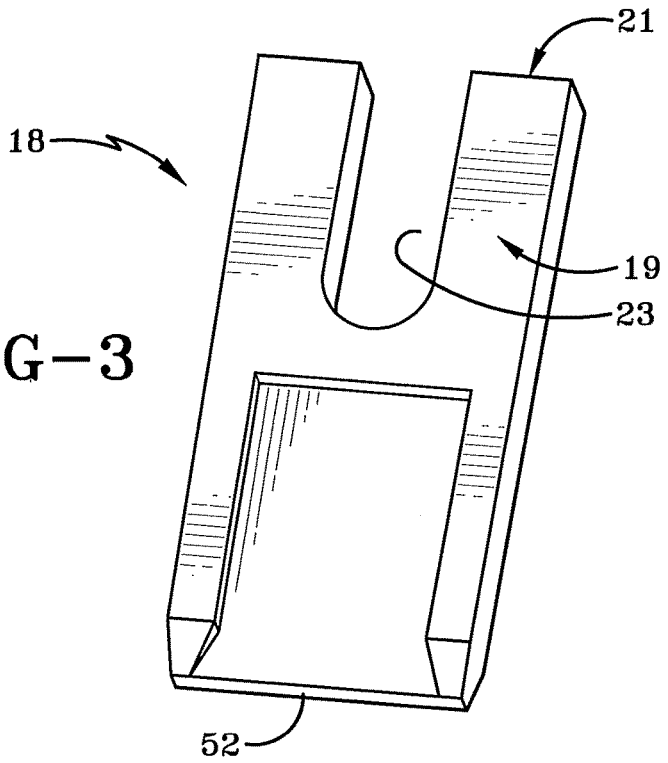
FIG. 3 is a perspective view of a cutter tooth.

As depicted in FIG. 3, each tooth 18 includes an upwardly facing top surface spaced opposite from a downwardly facing bottom surface. The top and bottom surfaces are bound by a leading edge which faces downwardly and an upper edge which faces upwardly. The leading edge 52 of tooth 18 is configured to cut through various substrates such as rock and dirt during the boring process when borer 10 is coupled with an auger or a drive system.

In one particular embodiment, a tang 19 of the tooth 18 defines an upper edge 21 of tooth 18 and forms a slot 23 having squared walls through which fastener 20 passes coupling tooth 18 to first wing 12 within gap 25 defined between flange 38 and support plate 44. The slot 23 is defined by parallel spaced apart sidewalls offset a distance complementary to a square body or neck 27 portion of carriage bolt 48. When tooth 18 is attached to plate 44, a square neck 27 of bolt 48 is disposed within the slot and prevents rotation of tooth 18 about an axis defined by bolt 48, but tooth 18 still revolves around longitudinal axis 26. Additionally, while the shown embodiment includes slot 23 for fastener 20 to pass therethrough, an aperture may be formed therein instead of a slot. An exemplary tooth 18 is commercially available for sale by Belltec Industries of Belton, Tex., model number 112008, which is 4140 steel that provides long life and increased production over traditional cutting teeth.

Figure 5:
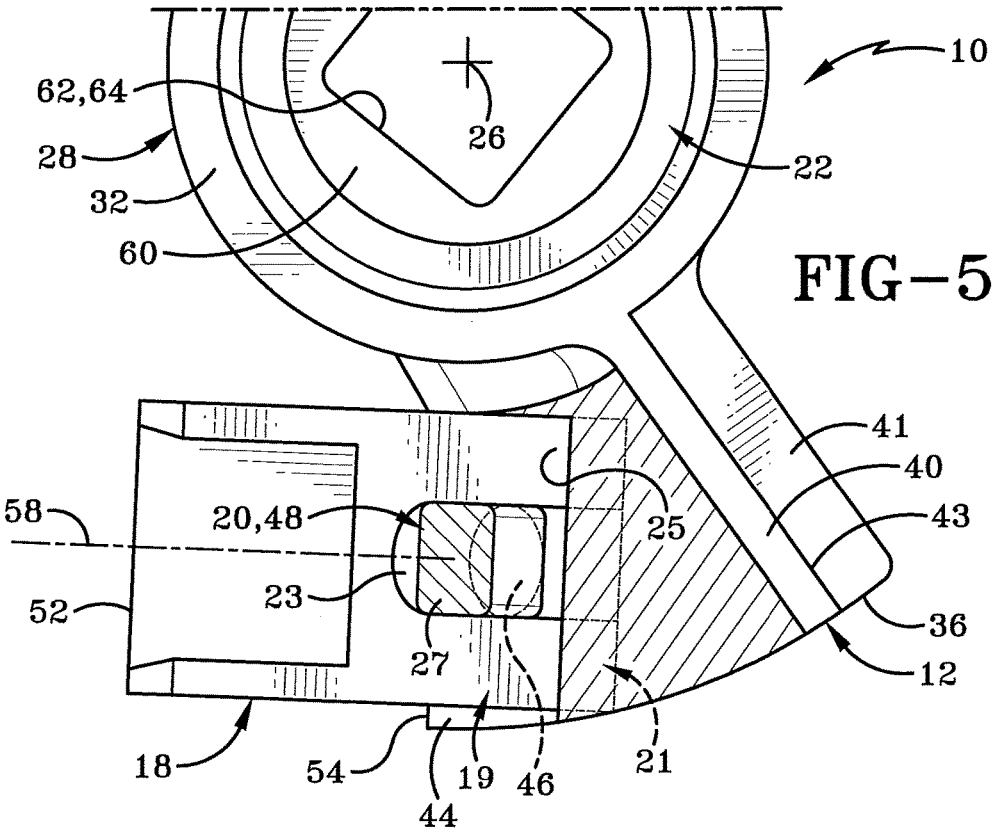
FIG. 5 is a cross section taken along line 5-5 in FIG. 4.
Figure 4:
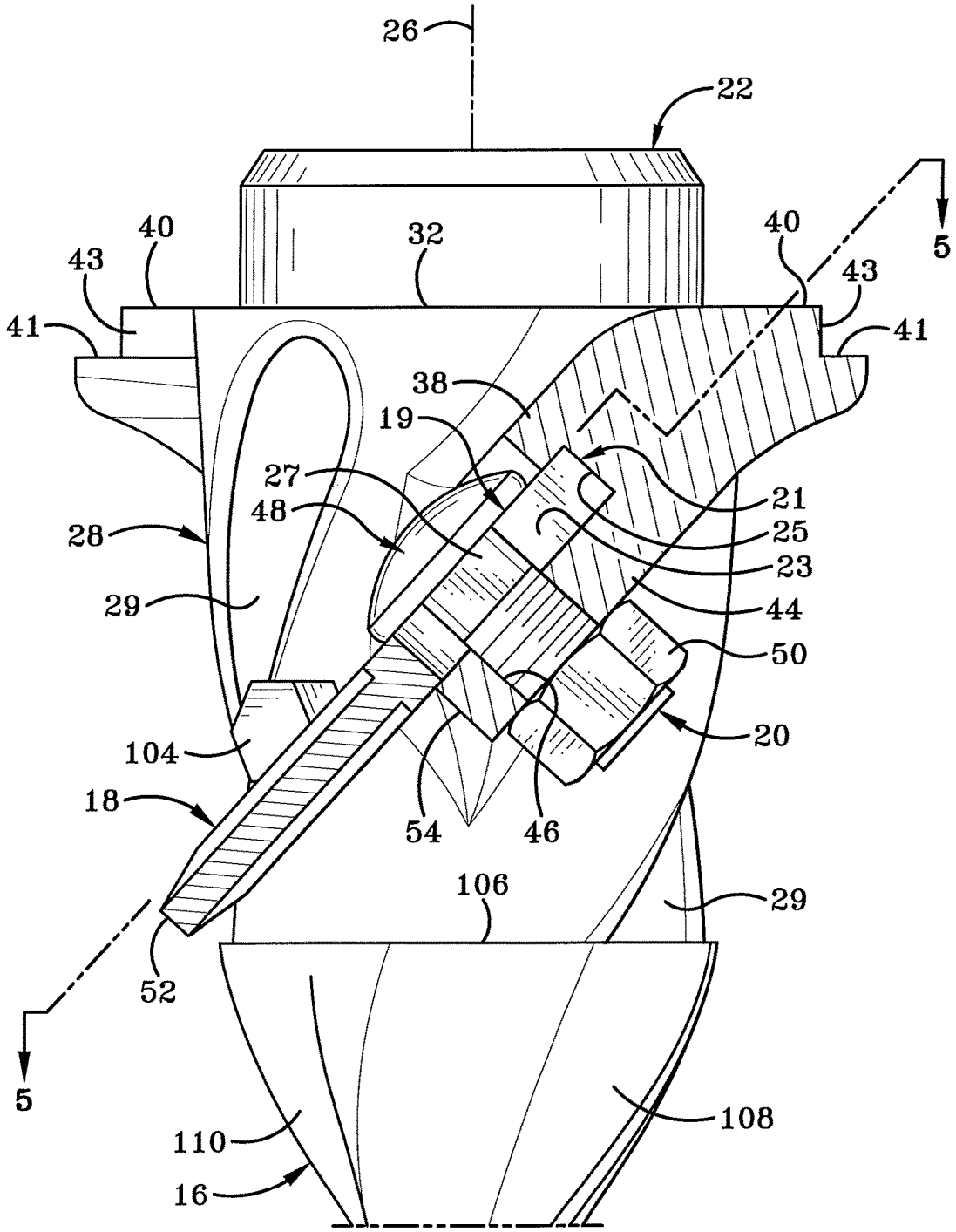
FIG. 4 is a cross section taken along line 4-4 in FIG. 2.
Figure 6:
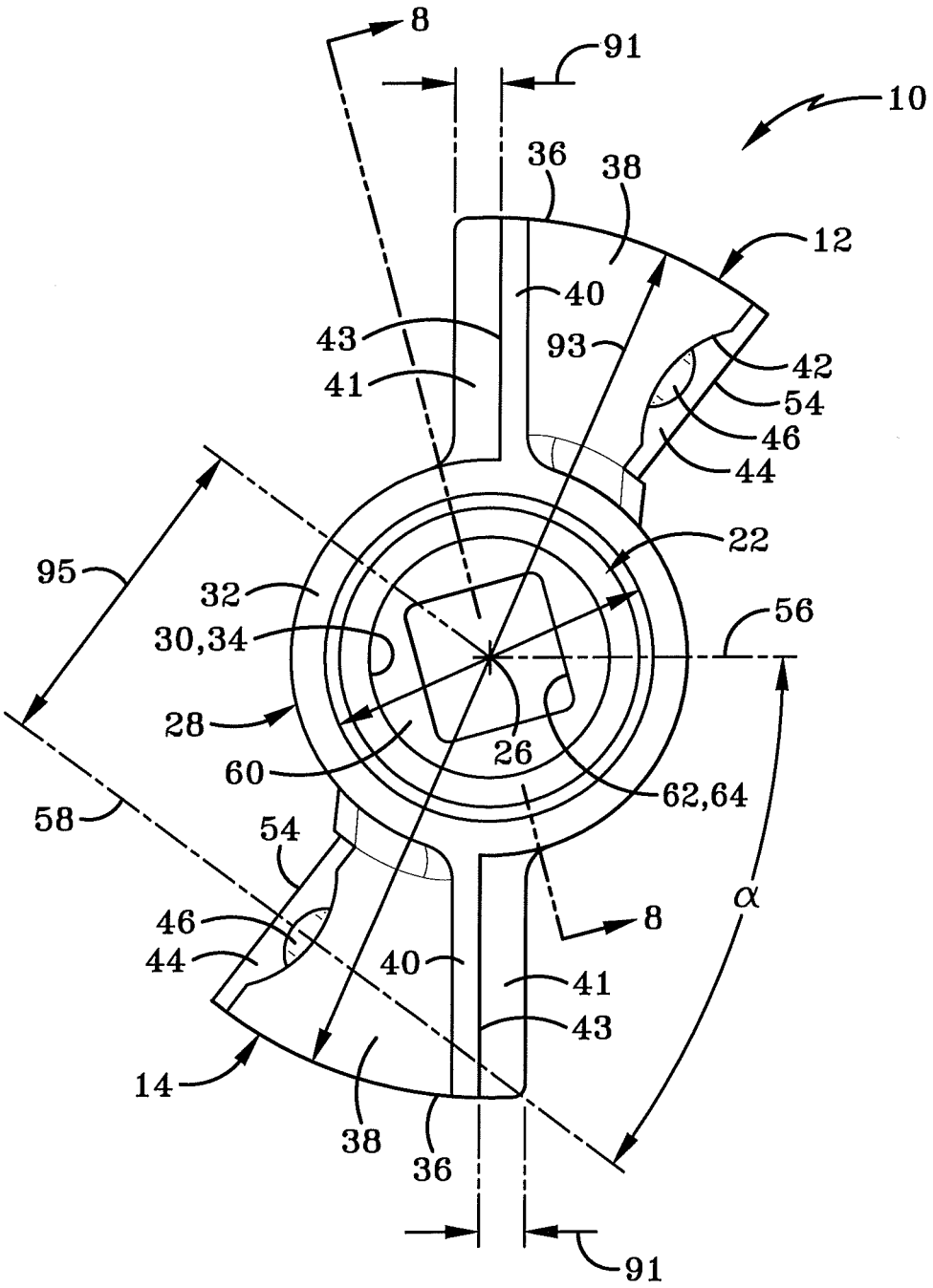
FIG. 6 is a top view of a first embodiment of the present disclosure.

As depicted in FIGS. 4-6, a leading edge 54 on support plate 44 is angularly displaced relative to a lateral axis 56 perpendicularly intersecting longitudinal axis 26 and extending diametrically through cylindrical body 28. The angular displacement angle $\alpha$ is measured from an imaginary intersector line 58 normal to leading edge 54 intersecting lateral axis 56 at angle $\alpha$. In one particular embodiment, support plate 44 is angularly displaced relative to lateral axis 56 an angle $\alpha$ of 36.2°. However, it is entirely possible that the angular displacement of leading edge 54 of support plate 44 being in a range from about 20° to about 60°. Aperture 46 is offset from center 26 a distance 93 measured to the center of aperture 46.

Figure 7:
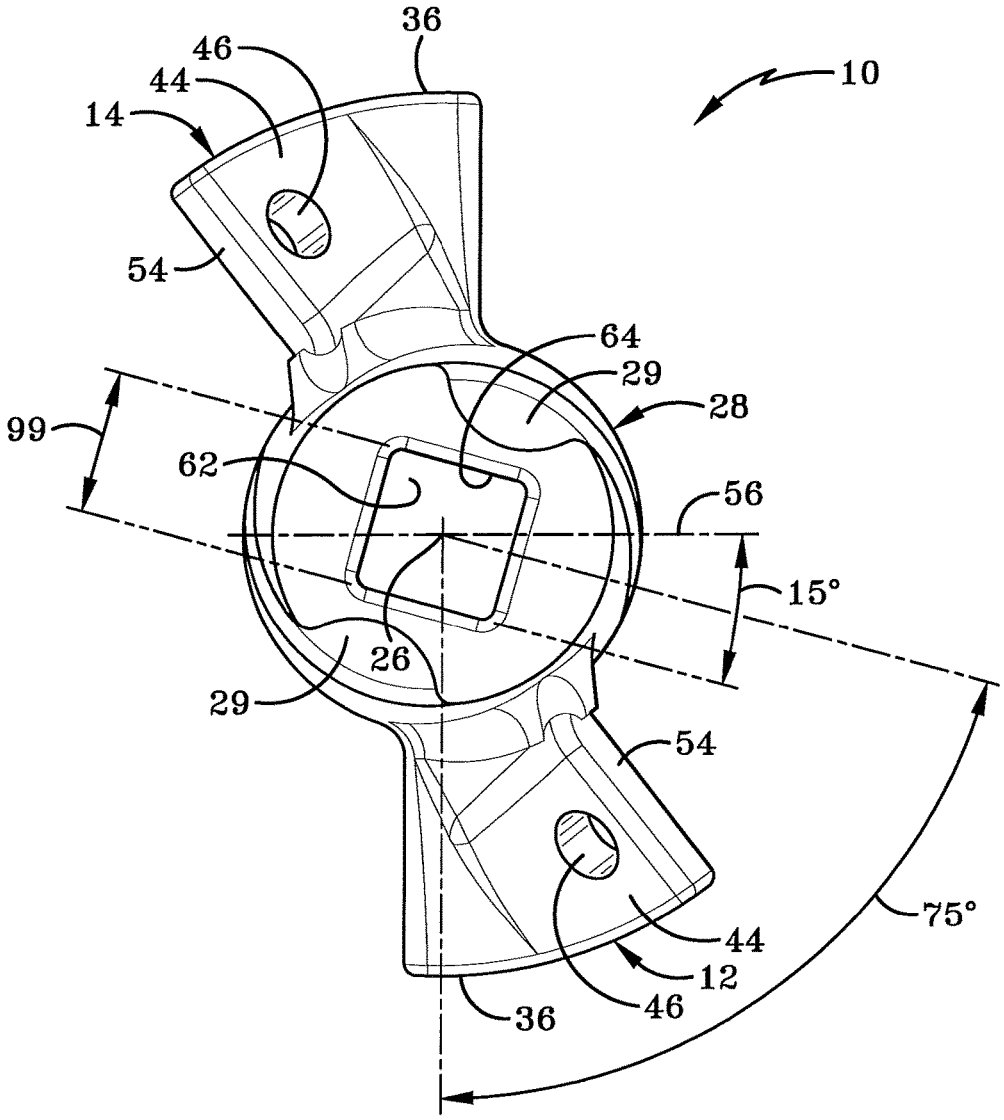
FIG. 7 is a bottom view of the first embodiment.

As depicted in FIG. 7, a bottom view of cylindrical body 28 is provided depicting square second aperture 62 in open communication with bore 30. Cylindrical body 28 is shown rotated 15° from lateral axis 56 such that a 75° angle is defined between a first square wall 64 having a width 99.

As depicted in FIG. 8, square wall 64 extends longitudinally for a depth of about 2.5" and has a width 99 of approximately 1". Aperture 62 is centered about longitudinal axis 26. Square wall 64 defines an aperture 68 extending radially through body 28. Aperture 68 is laterally oriented in an oblong manner when viewed in cross section having a vertical diameter of approximately 4.375" and a radial diameter of approximately 0.625".

With continued reference to FIG. 8, bore 30 has a width 66 and is bound by a bottom wall 60 and square wall 64 defines a square second aperture 62 adapted to receive a complimentary shaped insert 100 extending upwardly from pilot cutter 16 as will be described in greater detail below.

Figure 10:
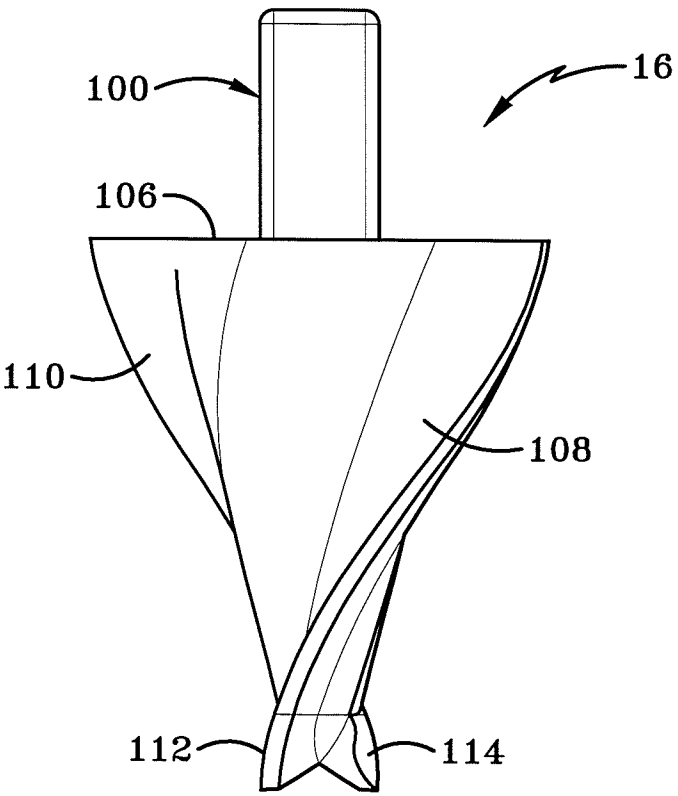
FIG. 10 is an isolated second side view of the cutter.
Figure 9:
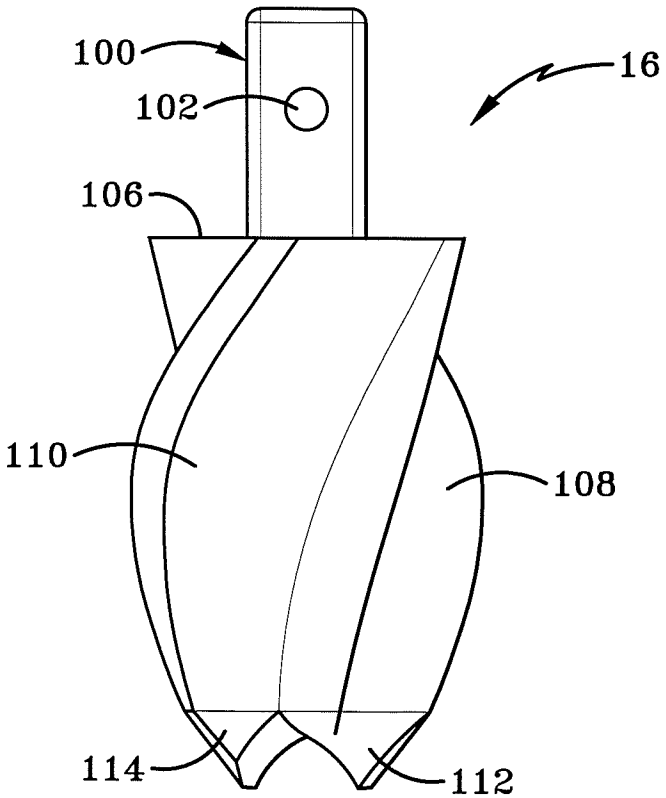
FIG. 9 is an isolated first side elevation view of a cutter included in each embodiment of the present disclosure.

As depicted in FIG. 9 and FIG. 10, pilot cutter 16 includes an upper insert member 100 shaped complimentary to square second aperture 62 and is designed to be inserted therein. Insert member 100 defines a laterally extending bore 102 configured to receive an attachment member or screw 104 to secure pilot cutter 16 to cylindrical body 28. Insert 100 extends upwardly from a rigid connection with shoulder 106 extending radially outward from two sides of insert 100. Shoulder 106 defines an upper end of two helical blades 108, 110. Each spiraling blade 108, 110 includes a continuous surface shaped arcuately in a helical manner terminating at a lower end defining a cutting first tooth 112 and cutting second tooth 114, respectively.

As depicted in the herein incorporated provisional application, another particular embodiment of the present disclosure 10 provides a second support plate 70 spaced radially outward (i.e., farther away from longitudinal axis 26) from first support plate 44 increasing the overall diameter of borer 10 measured from outer end 36 through longitudinal axis 26. The diameter of this embodiment from end-to-end of first wing 12 to second wing 14 is about 9". Second support late 70 is formed similar to support plate 44 defining an aperture 46 therethrough and is capped with an angled support plate 38 configured to receive an upper end of tooth 18 therein. Furthermore, tooth 18 is secured to second support plate 70 via fastener 20 extending through aperture 46 formed in second support plate 70. Second support plate 70 has a leading edge 72 offset from leading edge 54 and defining a second angular displacement relative to lateral axis 56.

As depicted in the provisional application, second support plate 70 having leading edge 72 is offset an angular distance from lateral axis 56 by an angle represented by $\alpha 2$. First support plate 44 having leading edge 54 is offset in angular displacement relative to lateral axis 56 by an angle represented by $\alpha 1$. In this particular embodiment, angular displacement $\alpha 2$ is less than angular displacement $\alpha 1$. Angular displacement $\alpha 1$, associated with leading edge 54 of first support plate 44, is shown at 55°. Angular displacement $\alpha 2$, associated with leading edge 72 of support plate 70, is shown at 20.9°. While the aforementioned angles are provided by way of example and not by limitation, it is understood that angular displacement $\alpha 1$ may be in a range from about 20° to about 65° and angular displacement $\alpha 2$ may be in a range from about 10° to about 50°. However, in each embodiment $\alpha 1$ is larger than or equal to $\alpha 2$. Furthermore, while it is not shown in the instant disclosure, there may be some desirable embodiments which may provide $\alpha 2$ larger than $\alpha 1$.

Figure 11:
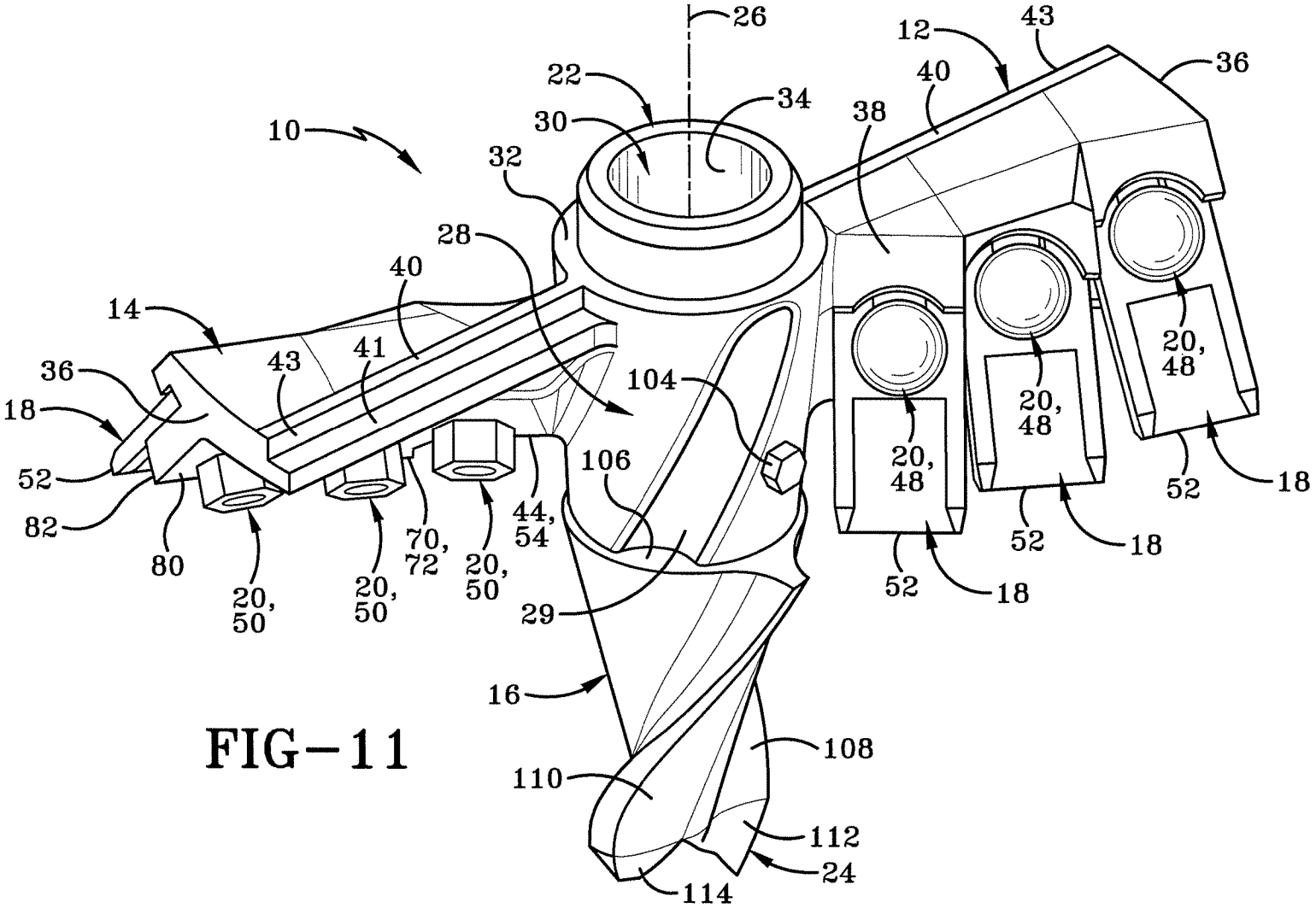
FIG. 11 is a perspective view of a second embodiment of the boring drill head.
Figure 12:
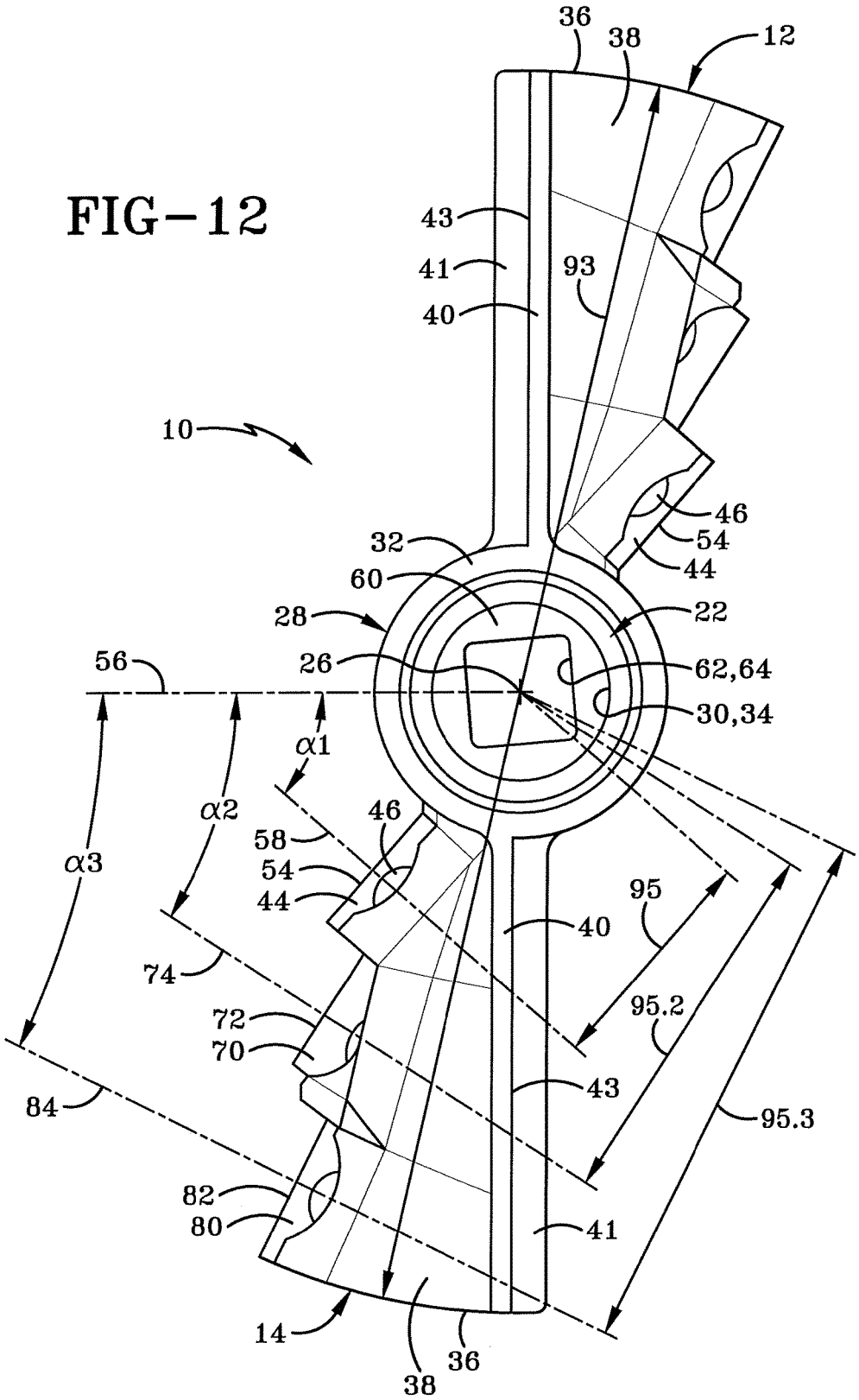
FIG. 12 is a top view of the second embodiment.

As depicted in FIG. 11 and FIG. 12, a third support plate 80 having a leading edge 82 may be provided radially outward from first and second support plates 44, 70 to increase the overall diameter 93 extending from end 36 through longitudinal center 26. The diameter 93 of this embodiment is about 15". An angular displacement $\alpha 3$ associated with leading edge 82 measured from an imaginary normal line 84 intersecting lateral axis 56 is less than $\alpha 2$ associated with leading edge 72 on second support plate 70 measured from imaginary line 74 intersecting lateral axis 56. Additionally, angular displacement $\alpha 3$ associated with support plate 80 is smaller than angular displacement $\alpha 1$ associated with first support plate 44. In the shown embodiment, angular displacement $\alpha 3$ of third support plate 82 is less than angular displacement $\alpha 2$ of support plate 70, which is less than angular displacement $\alpha 1$ of first support plate 44. By way of example, and not as a limitation, angular displacement $\alpha 1$ of support plate 44 is shown as 41.6°, angular displacement $\alpha 2$ of second support plate 70 is shown at 32.6°, and angular displacement $\alpha 3$ of third support plate 80 is shown at 27.0°. Angular displacement $\alpha 3$ may be in a range from about 10° to about 50°. Angular displacement $\alpha 3$ is less than angular displacement $\alpha 2$ which is less than angular displacement $\alpha 1$. Aperture 46 on plate 70 is spaced from center a distance 95.2. Aperture 46 on plate 80 is spaced from center a distance 95.3 Distance 95.3 is greater than distance 95.2 and distance 95.

As depicted in the herein incorporated provisional application, a fourth support plate 90, including a leading edge 92, is positioned radially outward from third support plate 80 increasing the overall diameter measured from outer end 36 through longitudinal center 26. An angular displacement α4 is measured from an imaginary line 94 normal to leading edge 92 on fourth support plate 90. Angular displacement α4 is less than angular displacement α3 associated with third support plate 80, which is less than angular displacement α2 associated with second support plate 70, which is less than angular displacement α1 associated with first support plate 44. In this particular embodiment, angular displacement α4, associated with fourth support plate 90, is shown at 14.6°. However, it may be in range from about 8° to about 30°. Furthermore, it is contemplated that angular displacement α4 is less than or equal to angular displacement α3.

The purpose of these multiple disclosures depicting multiple support plates 70, 80, 90 indicates that the overall diameter measured from outer edge 36 through longitudinal center 26 may be applied with a plurality of support plates extending outwardly beyond the first, second, third, or fourth support plate. In each embodiment, the angular displacement αN, associated with an Nth number support plate is less than angular displacement αN−1, associated with the N−1 support plate.

Each support plate is designed to secure a tooth 18 thereupon with a fastener 20 and held in place in a gap 25 defined between the top surface of the respective plate and a sloped flange 38. Notably, each support plate is sloped at an angle of approximately 45° and in one particular embodiment the angle of each support plate may be in a range from about 40° to about 50° imparting a sloped cutting angle of teeth 18. Thus, the teeth 18 are angled at a lifting pitch angle, when viewed from the side. Furthermore, it is to be clearly understood throughout the entirety of these figures that while reference has been made to the teeth and support plates on first wing 12, a mirrored relationship of teeth exist on second wing 14 diametrically opposite first wing 12 relative to longitudinal axis 26.

Figure 13:
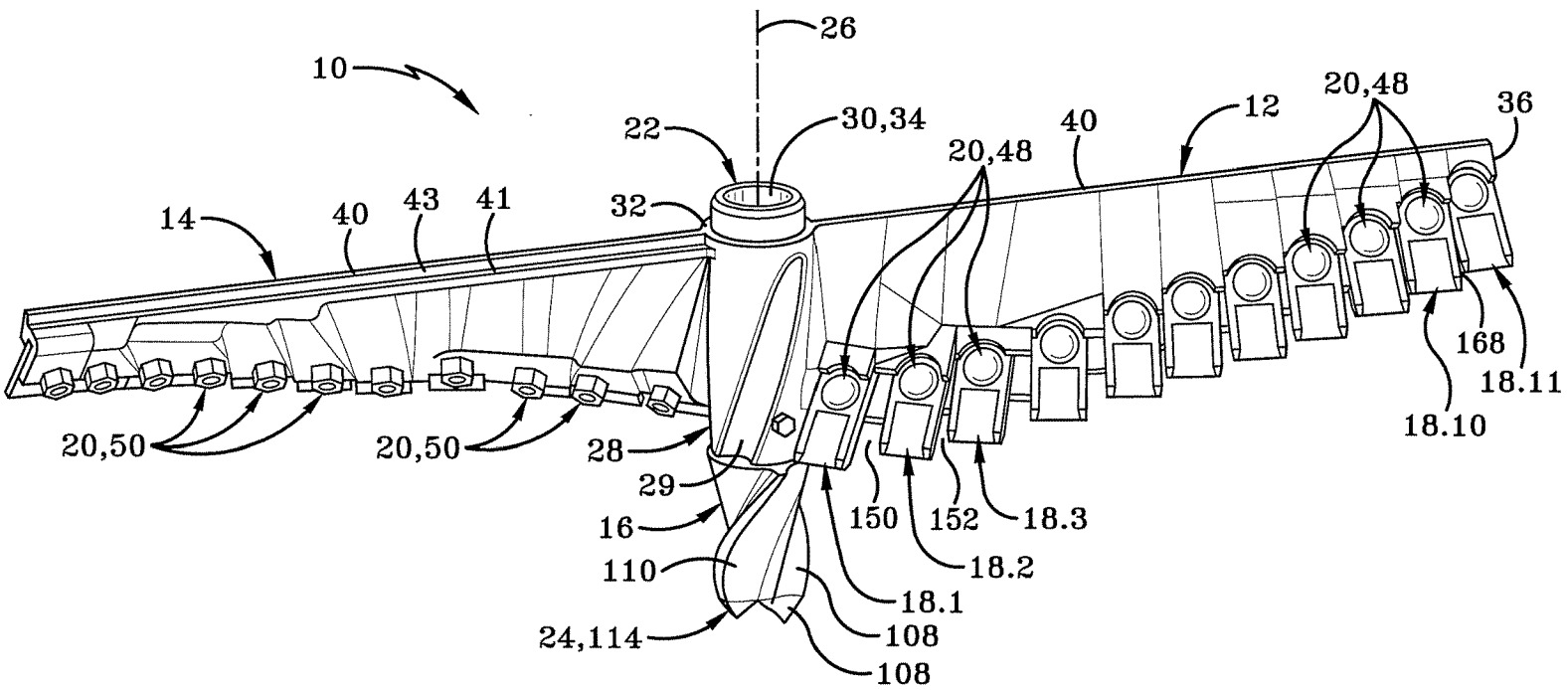
FIG. 13 is a perspective view of another exemplary embodiment of the present disclosure including a Nth number of cutting teeth optimized in a convex pattern.
Figure 14:
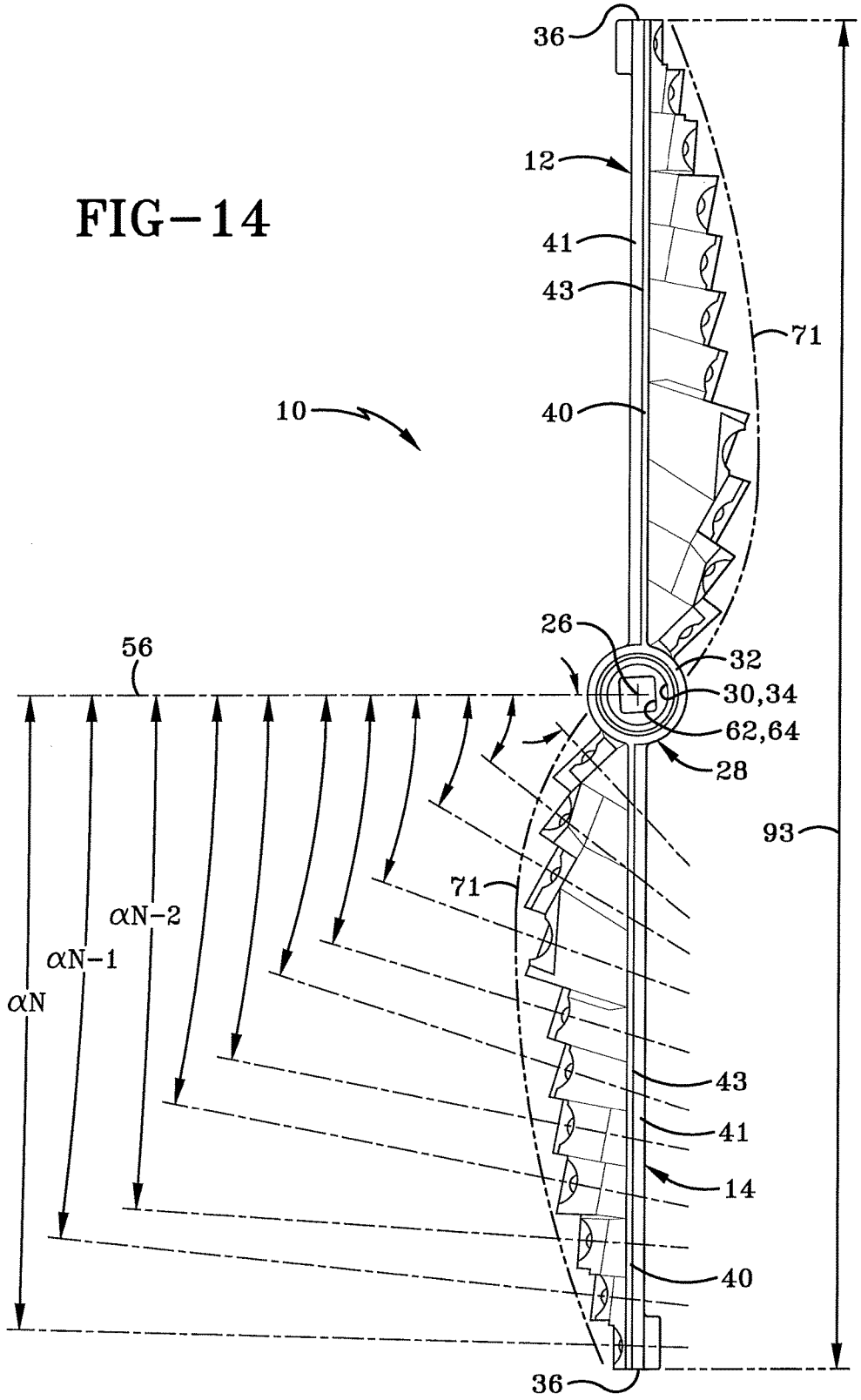
FIG. 14 is a top view of the exemplary embodiment including an Nth number of cutting teeth.

Furthermore, as the number of teeth 18 increase on each wing 12, 14, a convex arrangement (see profile line 71 detailing convexly curved alignment) becomes more visible (See FIG. 13 and FIG. 14). As angular displacement αN is less than αN−1, the convex pattern 71 of teeth 18 is optimized to cut through the downhole substrate. First wing 12 defines a convex teeth arrangement 71 facing the clockwise direction (when viewed from above) and similarly, second wing 14 defines a convex teeth arrangement facing the clockwise direction (when viewed from above). Each convex teeth arrangement extends radially from cylindrical body 28 towards end 36.

As depicted in FIG. 13, another exemplary embodiment of the present disclosure borer 10 is provided. This embodiment depicts a plurality of teeth, wherein there are eleven teeth on each wing. The same configuration of teeth applies wherein the angular displacement of αN is less than angular displacement αN−1. The convex optimized configuration is more clearly seen by the top view provided in FIG. 14.

In the arrangement depicted in FIG. 13, a first radial gap 150 is defined between first tooth 18.1 and second tooth 18.2. A second radial gap 152 is defined between second tooth 18.2 and third tooth 18.3. The radial gaps may continue radially along each wing to the Nth tooth (here eleventh tooth).

In one particular example, the radial gaps between the teeth 18 decrease in width as the teeth progress radially outward. For example, the tenth radial gap 168 defined between tenth tooth 18.10 and eleventh tooth 18.11 is narrower than second gap 152 which may be narrower than the first gap 150. This may be advantageous to provide narrower gaps as the teeth extend radially away from the body 28 to reduce the weight of borer 10 by narrowing the width of the support plates to which each respective tooth is attached. However, clearly it is entirely possible that the radial gaps may be a uniform distance as well.

As depicted in FIG. 14, the optimized convex configuration 71 of each wing is more clearly shown. The convex configuration of each support plate causes teeth 18 secured to each respective support plate in the convex configuration to "bite" (i.e., impact) the dirt and rock along a single horizontal plane at the same time, or substantially simultaneously, Further, the teeth positioned at an optimized angular displacement decreases a "radial pull" of borer 10. Radial pull refers to the forces that inhibit the teeth from simultaneously impacting the dirt and gravel along a horizontal plane while rotating. For example, if the wings were not convexly optimized, a radial pull force would urge the teeth near the radial end of each wing to deflect vertically because the outermost teeth are moving at a greater tangential velocity.

In accordance with an aspect and advantage of the present disclosure, borer 10 provides an improved device for boring a well into gravel, dirt, and rock substrate having teeth 18 angularly disposed diametrically about a longitudinal axis at different angular displacement angles. Notably, angular displacement αN is less than an angular displacement αN−1 positioned radially inward or closer to the longitudinal axis 26 creating an optimized convex arrangement. Additionally, borer 10 provides a self-aligning ledge 41 to quickly align the device with a helical body/blade on a rotary auger. A fastener 20 connects teeth 18 to support plates on respective first and second wings allowing teeth 18 to be replaced as leading edge 52 on teeth 18 is worn down through cutting.

In operation, a user can assemble borer 10 or borer 10 may be factory assembled. During assembly, pilot cutter 16 is coupled with body member 28 by inserting insert 100 vertically upward into second aperture 60 defined near the bottom end of body 28. A fastener 104 may be inserted into aperture 102 on insert 100 coupling pilot cutter 16 to body member 28. With the pilot cutter 16 and the body member 28 secured together, tooth 18 or a plurality of teeth may be secured on each of the first and second wings 12, 14.

Each of the pilot cutter 16 and body member 28 are preferably constructed of a material suitable for downhole drilling as one having ordinary skill in the art would understand. Some exemplary materials may include 4140 steel, or the like. Furthermore, it is contemplated that borer 10 will be constructed from cast metal in order to reduce production costs; however machined components are entirely possible. Additionally, the cast configuration of borer 10 does not decrease the strength of borer 10 relative to a machined borer 10.

A tooth 18 is aligned at its upper tang 19 end and inserted into the gap 25 defined between angled support flange 38 and first support plate 44. The gap 25 distance is complementary to the thickness of teeth 18. The shown embodiment displays a gap thickness of 0.41825 inches, however it is clearly understood that this distance may increase or decrease depending on the type of tooth that is used. After the upper end of tooth 18 has been slid into the gap, fastener 20 passes through a slot 23 portion of tooth 18 and also passes through aperture 46 of support plate 44 coupling tooth 18 to plate 44. In the shown embodiments, fastener 20 is a carriage bolt 48 and a nut 50 however other fastener types are entirely possible. Fastener 20 should be constructed of a material similar to that of cutter 16. In each of the shown embodiments, bolt 48 is a carriage bolt having a square neck 27.

Teeth 18 may be continued to be attached to the first and second wings 12, 14 occupying the space above each support plate formed on the first and second wings 12, 14. Throughout these figures, various embodiments of the present disclosure have been shown having one, two, three, or four support plates and respective teeth on each wing 12, 14. However, it is entirely understood that the number of teeth and support plates may be expanded out wherein each wing 12, 14 has a total teeth number N per wing, and the overall device has a plurality of teeth equal to N×2.

With the teeth 18 fastened via 20 to each wing 12, 14, the top end 22 of borer 10 is coupled with a drive shaft 61 of an auger 51. More particularly, the self-aligning ledge 41 contacts a bottom edge 67 of a helical body/blade on a rotary to align borer 10 therewith. The auger may have a single or double helical blade winding down therearound as one having ordinary skill in the art would understand. Furthermore, the drive shaft of the auger may be inserted into first aperture 30 and coupled onto shoulder 32 as one having ordinary skill in the art would understand.

In use, a motor drives the auger coupled to borer 10 imparting rotational movement in the direction of arrow A (FIG. 1) to the borer causing the two pilot fishtail teeth 112, 114 on the pilot cutter 16 adjacent bottom end 24 to begin cutting into a ground material as borer 10 rotates in a clockwise direction (when viewed from above or counter-clockwise when viewed from below). As borer 10 continues to rotate in a clockwise direction (when viewed from above or counter-clockwise when viewed from below), the cutting surfaces on blades 108, 110 move the cut ground or dirt upwards along the curved helical surface of each respective blade 108, 110. Leading edges 52 of the plurality of teeth 18 are rotating in unison in a clockwise direction (when viewed from above or counter-clockwise when viewed from below) with the rest of the elements of borer 10 causing leading edge 52 to impact dirt, rock, and gravel boring downward at the angle of support plate 44 as borer 10 rotates clockwise (when viewed from above or counter-clockwise when viewed from below).

As borer 10 continues to rotates, the convexly optimized arrangement (see FIG. 14) of teeth permits teeth 18 to impact (e.g. to "bite") the dirt and rock at a depth along a horizontal plane simultaneously, or as close to substantially simultaneously as possible. This advantage prevents the outermost teeth, which have a greater tangential velocity than the inner teeth, from longitudinally displacing during rotation. Particularly, the convexly optimized teeth, where angular displacement $\alpha N$ is less than angular displacement $\alpha N-1$, prevents the outermost teeth from rising up (i.e., vertically displacing relative to longitudinal axis 26) during downhole drilling.

The continual use of teeth 18 will cause leading edge 52 to wear down over time, necessitating the replacement of teeth 18. To replace a worn tooth 18, fastener 20 is released. In this particular embodiment, fastener 20 is released by unscrewing nut 50 from threaded end on bolt 48 and removing the bolt from its coupling relationship relative to support plate 44 and the upper end of tooth 18. A new tooth 18 may then be inserted and secured via the same or a new fastener 20 as described above.

Additional embodiments may exist that are within the scope of the present disclosure including additional components. For example, additional cutting bits extending radially away from longitudinal axis 26 along first and second wings 12, 14 that provide constant engagement by boring device 10 with the ground/rock downhole substrate.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

What is claimed:

1. A boring drill head attachment for an auger comprising:

a body having an upper end opposite a lower end, the body centered about a vertically aligned longitudinal axis, the body adapted to attach to a downhole end of a substrate lifting helical flight on the auger;

a first wing extending transversely outward from a first rigid connection with the body; and a first angled tooth support plate on the first wing having an angled upwardly facing top surface and a bottom surface, the support plate defining an aperture extending therethrough;

an earth cutting tooth supported by the first wing adjacent the angled upwardly facing top surface;

the cutting tooth defining a slot aligned with the aperture, wherein the aligned slot and aperture are adapted to receive a fastener therethrough;

wherein the first angled tooth support plate is one of a plurality of support plates extending outwardly along the first wing and arranged side-to-side; wherein each one of the plurality of support plates includes a leading edge angularly displaced relative to a lateral axis associated with the body perpendicularly intersecting the longitudinal axis, and each one of the plurality of support plates defines a respective centrally aligned aperture extending from the top surface to the bottom surface;

a first displacement angle associated with the leading edge of the support plate;

a second displacement angle associated with the leading edge of a second support plate farther away from the body; and wherein the first displacement angle is different than the second displacement angle.

2. The boring drill head attachment for the auger of claim 1, further comprising the fastener and wherein the earth cutting tooth comprises a tang having squared sidewalls forming the slot and the fastener is a carriage bolt having a squared neck sized to fit within the slot and prevent rotation of the fastener and cutting tooth when the carriage bolt is installed through the slot and aperture and secured with a nut.

3. The boring drill head attachment for the auger of claim 1, wherein the aperture is aligned in the center of the support plate.

4. The boring drill head attachment for the auger of claim 1, wherein the first displacement angle is greater than the second displacement angle.

5. The boring drill head attachment for the auger of claim 4, further comprising a convexly curved arrangement of the plurality of support plates when viewed from above.

6. The boring drill head attachment for the auger of claim 4, further comprising a radially aligned gaps formed between adjacent teeth, wherein the gaps decrease as the teeth progress radially outward.

7. The boring drill head attachment for the auger of claim 1, further comprising a trailing ledge on the first wing adjacent the upper end of the body, the trailing ledge adapted to self-align the boring drill head attachment to the helical flight on the auger.

8. The boring drill head attachment for the auger of claim 1, wherein the body defines at least one helically winding flute formed in an outer surface of the body.

9. The boring drill head attachment for the auger of claim 1, further comprising a pilot cutter extending downwardly from the lower end of the body, the pilot cutter including at least two teeth defining a fishtail configuration and two respective helical blades extending upwardly therefrom and terminating near the lower end of the body.

10. The boring drill head attachment for the auger of claim 9, wherein the pilot cutter further includes an upper insert member; and the body defines second aperture extending centrally therethrough along the longitudinal axis;

wherein the upper insert member is shaped complementary to the second aperture and is inserted therein.

11. The boring drill head attachment for the auger of claim 5, a second wing extending outward in another direction from a second rigid connection with the body, the second wing comprising:

a plurality of second wing support plates extending outwardly along the second wing and arranged side-to-side; wherein each one of the plurality of second wing support plates includes a leading edge angularly displaced relative to the lateral axis associated with the body perpendicularly intersecting the longitudinal axis, and each one of the plurality of second wing support plates defines a respective centrally aligned aperture extending through each support plate.

12. The boring drill head attachment for the auger of claim 11, wherein the first rigid connection is diametrically opposite the second rigid connection relative to the body.

13. A boring drill head attachment for an auger comprising:

a central body adapted to attach to a downhole end of a substrate lifting helical flight on the auger;

a first wing extending transversely outward from a first rigid connection with the body to a wing end;

a plurality of plates supporting teeth on the first wing, each plate including a leading edge;

each leading edge respectively associated with the plurality of plates offset at a displacement angle relative to a lateral axis associated with the body that perpendicularly intersects a longitudinal axis of the body; and a convexly curved arrangement of the leading edges of plurality of support plates when viewed from above.

14. The boring drill head attachment for the auger of claim 13, further comprising:

a first displacement angle associated with the leading edge of a first support plate;

a second displacement angle associated with the leading edge of a second support plate farther away from the body;

wherein the first displacement angle is greater than the second displacement angle.

15. The boring drill head attachment for the auger of claim 14, wherein at least one of the plurality of plates defines an aperture extending therethrough for repeatably receiving a fastener therethrough.

16. A method of drilling a hole with an auger, comprising the steps of:

providing a body having an upper end opposite a lower end centered about a vertically aligned longitudinal axis, the body attached to a downhole end of a helical flight on the auger, and further having a first wing including a tooth support plate having an angled upwardly facing top surface and a bottom surface, the support plate defining a aperture extending therethrough, and further a tooth defining a slot aligned with the aperture coupled to the support plate via a fastener;

rotating the body about the longitudinal axis and moving the tooth in unison therewith;

contacting a downhole substrate with the tooth;

lifting substrate upwards;

preventing the tooth from dislodging from the support plate when the auger is reversed;

reducing radial pull of an outermost tooth simultaneous with the step of lifting substrate upwards, wherein the step of reducing radial pull is accomplished by:

providing a plurality of teeth, wherein each tooth from the plurality of teeth is supported by a corresponding tooth support plate; and aligning a leading edge on each tooth from the plurality of teeth at a different displacement angle relative to the body; wherein the aligned leading edges form a convexly curved arrangement when viewed from above.

17. A boring drill head attachment for an auger comprising:

a body having an upper end opposite a lower end, the body centered about a vertically aligned longitudinal axis, the body adapted to attach to a downhole end of a substrate lifting helical flight on the auger;

a first wing extending transversely outward from a first rigid connection with the body;

a plurality of support plates extending outwardly along the first wing and arranged side-to-side; wherein each one of the plurality of support plates includes a leading edge angularly displaced relative to a lateral axis associated with the body perpendicularly intersecting the longitudinal axis, and each one of the plurality of support plates defines an aperture extending from the top surface to the bottom surface; and wherein each of the plurality of support plates is adapted to support a tooth thereon.

* * * * *